US005803133A

United States Patent [19]

Slosse et al.

[11] Patent Number: 5,803,133

[45] Date of Patent: Sep. 8, 1998

[54] SELVAGE-FORMING DEVICE FOR A POWER LOOM

[75] Inventors: Kurt Slosse, Boezinga; Patrick Glorie, Ieper; Ignace Meyns, Reninge, all of Belgium

[73] Assignee: Picanol N.V., Ieper, Belgium

[21] Appl. No.: 776,195

[22] PCT Filed: Sep. 20, 1995

[86] PCT No.: PCT/EP95/03704

§ 371 Date: Apr. 28, 1997

§ 102(e) Date: Apr. 28, 1997

[87] PCT Pub. No.: WO96/38608

PCT Pub. Date: Dec. 5, 1996

[30] Foreign Application Priority Data

May 29, 1995 [BE] Belgium ..... 9500474

[51] Int. Cl.[6] ..... D03C 11/00

[52] U.S. Cl. ..... 139/54; 139/430

[58] Field of Search ..... 139/54, 430–434

[56] References Cited

U.S. PATENT DOCUMENTS 4,614,210 9/1986 Debaes ..... 139/54

5,123,454 6/1992 Debaes ..... 139/54

FOREIGN PATENT DOCUMENTS 0 306 078 3/1989 European Pat. Off. .

0 519 550 12/1992 European Pat. Off. .

1151498 6/1966 United Kingdom .

*Primary Examiner*—Andy Falik

*Attorney, Agent, or Firm*—Bacon & Thomas

[57] ABSTRACT

A power loom selvage forming device includes at least two thread guide elements for guiding selvage threads. The thread guide elements are guided in longitudinal guides and are connected by transmission elements to a drive shaft driven by a drive motor. The axis of the drive shaft is perpendicular to the direction of motion of the thread guide elements, with the transmission element converting the rotations of the drive motor into longitudinal motions of the thread guide elements containing at least one element mounted on the drive shaft and including articulation points eccentric to the drive shaft and at a mutual angular separation. The drive motor is rotatable by a control into predetermined angular positions at predetermined times.

16 Claims, 3 Drawing Sheets

SELVAGE-FORMING DEVICE FOR A POWER LOOM

BACKGROUND OF THE INVENTION

1. Field Of The Invention

The invention concerns a selvage-forming device for a power loom having at least two thread guide elements guiding two selvage threads, said elements being mounted in an extension of the shed and which, to create a shed from the selvage threads, are driven in mutually opposite lifting and lowering directions by a drive motor.

2. Related Technology

Selvage forming devices are used in power looms to form a selvage of a fabric or to form a scrap strip to be severed from the fabric. The selvage threads are guided in such manner along the thread guide elements that they form an opening and closing shed as an extension of the weaving shed, said selvage shed receiving fillings that then are bound into these selvage threads in a predetermined pattern.

There are two types of selvage-forming devices. In the first kind, thread guide elements are provided in the loom's shed forming system, as a result of which the guide elements move along with the loom's shed forming system. This first type only allows implementing a weave with the selvage threads corresponding to the weave formed by the shed forming system of the loom. In the second type the selvage forming device, the device includes its own drive displacing the thread guide elements independently of the loom shed forming means.

In a known design of the second type (European patent document A 051 95 50), the drive of the thread guide elements is powered by the main shaft of the loom. In this known design the drive is configured above the thread guide elements that carry out rectilinear opposed motions inside guide means. The thread guide elements are connected by coupling bars to a rail which in turn is connected to a cable displaced by a spring in one direction and by a drive lever in the other direction, said drive lever being connected to the loom's main shaft. This known selvage forming device allows making specific weaves, for instance a one/one weave wherein a weave or binding is formed for every filling insertion, or a two/two weave wherein a weave is formed after the insertion of two fillings. To pass from one weaving pattern to the other, drive elements, for instance gears, must be exchanged between the drive lever and the loom main shaft. This exchange is costly and requires shutting the loom down. If cam drives are used, other weave patterns may be formed, for instance one/two weaves, wherein the filling from a first insertion is bound and then the two following insertions are bound together. In order to change the particular set weave pattern, cams of the cam drive must be replaced by other cams. This exchange is costly and requires shutting down the loom.

Moreover a selvage-forming device of the initially cited species is known from the European Patent Application A 030 60 78 wherein a drive motor synchronized with the loom weaving cycles, that is with the main drive motor, drives the thread guide elements. In this design the thread guide elements are linked in such manner to a drive shaft that the lifting and lowering displacements are caused by a pivoting motion of the thread guide elements which additionally also move longitudinally. To convert the rotational motion of the drive motor into the pivoting motion, the thread guide elements also undergo a superposed longitudinal motion and are guided inside a closed slot guide forming a substantially rectangular guide track for the guide elements.

BRIEF SUMMARY OF THE INVENTION

The object of the invention is to create a selvage forming device of the initially cited species having a simple design and allowing changing the weave in a simple manner.

The invention solves this problem in that the thread guide elements are guided in longitudinal guides and are linked by transmission elements to a shaft in turn driven by the drive motor, the axis of said drive shaft being perpendicular to the direction of displacement of the thread guide elements, in that the transmission elements converting the rotation of the drive motor into longitudinal displacements of the thread guide elements contain at least one element mounted on the drive shaft and are fitted with mutually angularly spaced articulation points eccentrically arrayed relative to the drive shaft, and in that the drive motor can be rotated by a control unit at predetermined times into predetermined angular positions.

The selvage forming device of the invention evinces a simple design in particular regarding the longitudinal guides and the transmission elements, achieving low friction and low wear. Moreover the positions where the selvage threads cross and in which the selvage threads implement the filling weave are adjustable in a simple and accurate manner because essentially they depend on the angular separation between the articulation points. The invention offers a special advantage in that the control system allows changing the kind of weave even during weaving in simple manner, without the need to shut down the loom and/or to exchange parts.

In implementation of the invention, the angular separation of the articulation points is larger than 120°. Such a configuration is advantageous with respect to the torque to be delivered by the drive motor. With respect to the height of crossing, the angular separation of the articulation points advantageously shall be less than 180°.

In a further embodiment of the invention, the articulation points are adjustable radially relative to the axis of the drive shaft. Thereby, the magnitude of the longitudinal displacement of the thread guide elements can be changed during lifting and lowering by adjusting the radial spacing of the articulation points relative to the drive shaft.

In a further embodiment of the invention, two cranks are mounted on the drive shaft, which preferably is the motor shaft of the electric motor, and are connected to the transmission elements for a particular thread guide element. This configuration allows easy and simple construction. In a first embodiment mode two cranks each associated to one thread guide element constitute one unit. If, in this design, the angular separation between the articulation points is to be changed, then it suffices to exchange the one unit formed by the two cranks. In another embodiment, two separate cranks for the guide elements are mounted on the drive shaft, the angular separation between the cranks preferably being adjustable. In this embodiment the angular separation between the cranks and hence between the articulation points can be carried out without changing parts.

In a further embodiment of the invention, means are provided to transmit the actual angular position of the motor shaft and/or the position of the guide thread elements to the control unit. As a result, the control unit always knows the angular position of the motor shaft and hence that of the thread guide elements, thereby precluding errors during the motion of the thread guide elements.

In an advantageous embodiment, the drive motor is a stepper motor. Such a stepper motor allows accurately approaching predetermined angular positions. Therefore, this embodiment also provides for mounting a reference stop outside the normal displacement path of the rotatable element or a transmission element or a thread guide element, that can be approached as a reference position by means of the stepper motor. The control unit is able to self-calibrate by approaching the reference position; that is, it may acquire knowledge of the actual motor shaft position and hence the position of the thread guide elements.

In a further embodiment of the invention, the electric motor, the thread guide elements and the transmission elements are combined into one module. Such a module is easily mounted on a power loom or removed from it. Also such a module is easily shifted at the power loom to match the loom's fabric width.

In another embodiment of the invention, the drive shaft is mounted above the thread guide elements. In this manner, the selvage forming device is made easily accessible and visible on the loom.

BRIEF DESCRIPTION OF THE DRAWINGS

Further features and advantages of the invention are elucidated in the following description of the illustrative embodiments shown in the drawings.

DETAILED DESCRIPTION

Figure 1:
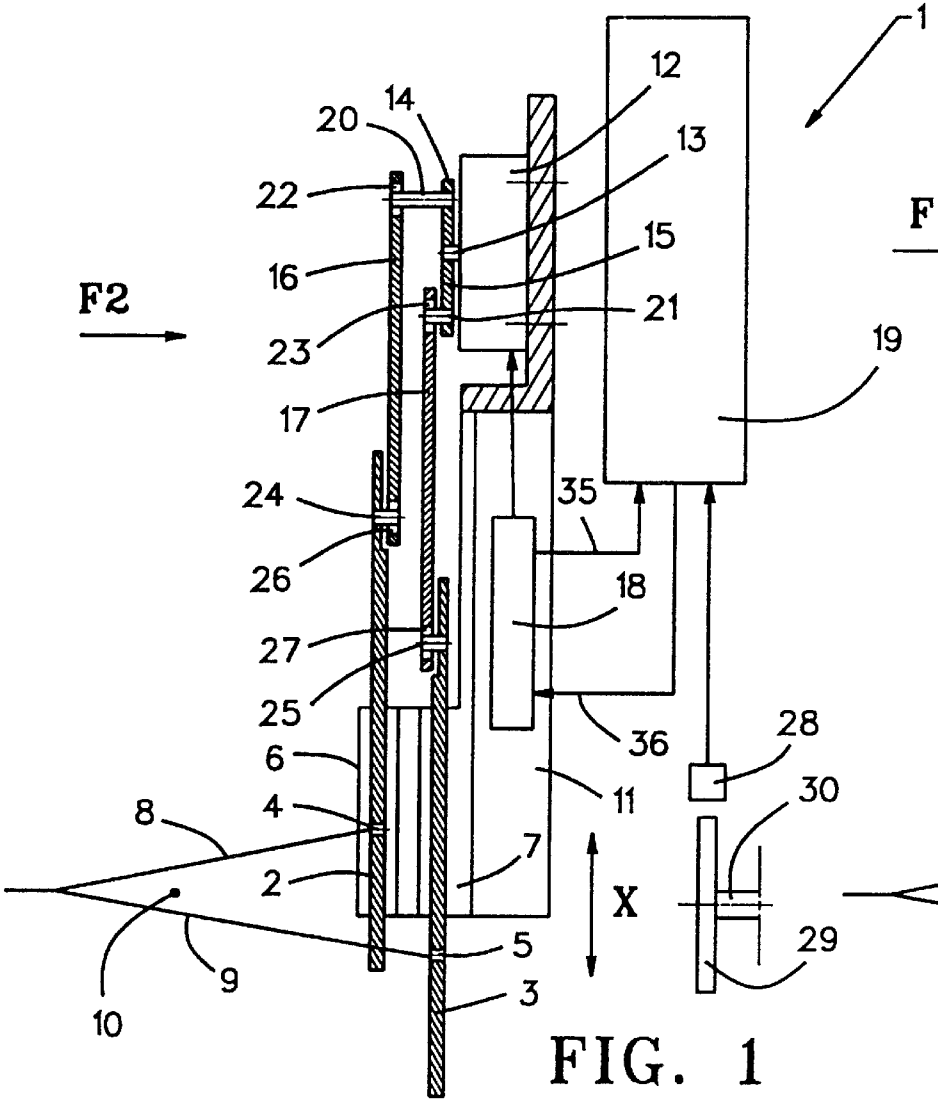
FIG. 1 is a partly sectional schematic of a selvage forming device of the invention.

A selvage forming device 1 of the invention is shown in FIGS. 1 through 4 and comprises two selvage thread guide elements 2, 3 fitted with thread guides 4, 5 for selvage threads 8, 9. The guides 4, 5 of the guide elements 2, 3 and the selvage threads 8, 9 are shown in FIG. 1 in a manner displaying the shed 10 formed by the selvage threads 8, 9. The thread guide elements 2, 3 are guided rectilinearly in longitudinal guides 6, 7 and carry out opposite motions in the direction of the arrow X in order to form a shed 10 each time and to thereby weave or bind one or more inserted fillings. The guides 6, 7 are affixed to each other and to a frame 11 which in turn is fastened to a loom framework.

The selvage forming device 1 comprises a drive unit mounted above the bar-structured thread guide elements 2, 3. The drive unit includes a drive motor 12 affixed to the frame 11 and with a motor shaft 13. Two cranks 14, 15 are mounted on the motor shafts 13 acting as drive shaft and are linked by transfer elements or coupling rods 16, 17 resp. to one of the thread guide elements 2, 3. Relative to the motor shaft 13, the cranks 14, 15 are located on mutually opposite sides, and upon rotation of the motor shaft 13, the thread guide elements 2, 3 carry out opposite motions in the direction of the arrow X. The cranks 14, 15 subtend an angular separation A on the side facing the thread guides 2, 3, said angle A being larger than 120° and smaller than 180°. In the embodiment shown, the angle A is approximately 150°. The drive motor 12 preferably is a stepper motor and is connected to a local motor control unit 18 which in turn is connected to the loom's control unit 19. Together with the drive motor 12, the local control unit 18, the cranks 14, 15 and the coupling rods 16, 17, the longitudinal guides 6, 7 and the thread guide elements 2, 3, the frame 11 constitutes one module that can be connected to a fixed portion of loom structure.

In the embodiment of FIGS. 1 through 4, the cranks 14, 15 are an integral component irrotationally affixed to the motor shaft 13 acting as the drive shaft of the drive motor. The cranks 15, 19 and the coupling rods 16, 17 are linked by pins 20, 21 constituting articulation points affixed to the cranks 14, 15 and each rotatably resting in bearings 22, 23 of the coupling rods 16, 17. The cranks 15, 19 and rod 16, 17 collectively form motion transmitting elements between the motor drive shaft 13 and the thread guide elements 2, 3. The thread guide elements 2, 3 and the coupling rods 16, 17 are connected through pins 24, 25 which are affixed to the thread guide elements 2, 3 and which are rotatably within bearings 26, 27 of the coupling rods 16, 17. The coupling rods 16, 17 and the cranks 14, 15 for both thread guide elements 2, 3 are of the same length. The coupling rods 16, 17 and the thread guide elements 2, 3 are mounted in parallel planes. The pins 20, 21, 24, 25 and the motor shaft 13 acting as a drive shaft run mutually parallel and perpendicularly to the longitudinal guides 6, 7 of the thread guide elements 2, 3.

Figure 2:
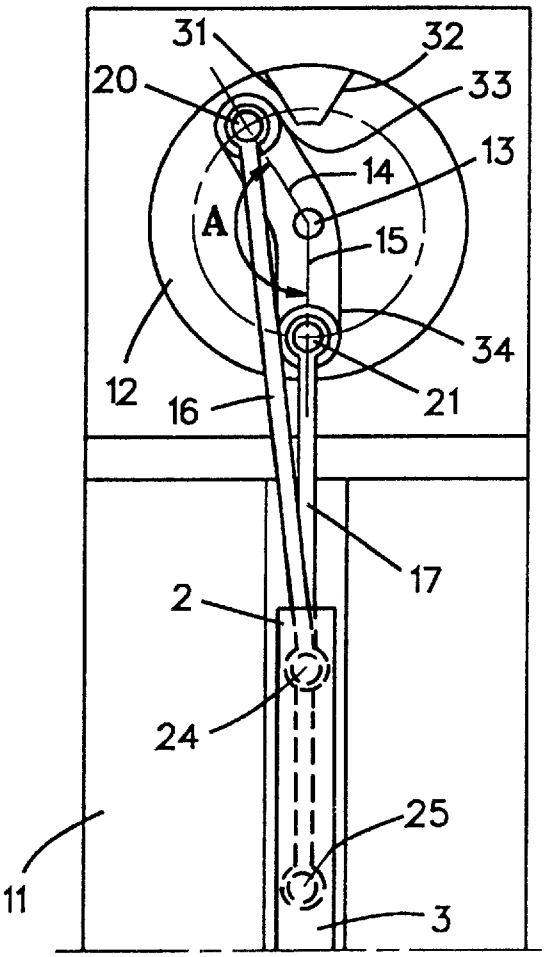
FIG. 2 is a view in the direction of the arrow F2 in FIG. 1, FIGS. 3, 4 are views of the selvage forming device corresponding to FIG. 2 at other positions of the thread guide elements.
Figure 3:
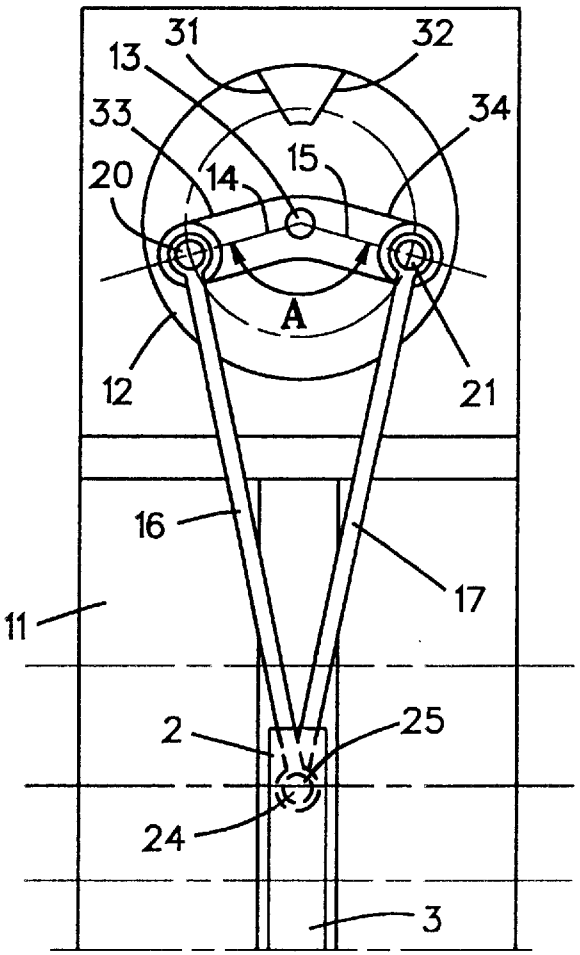
Figure 4:
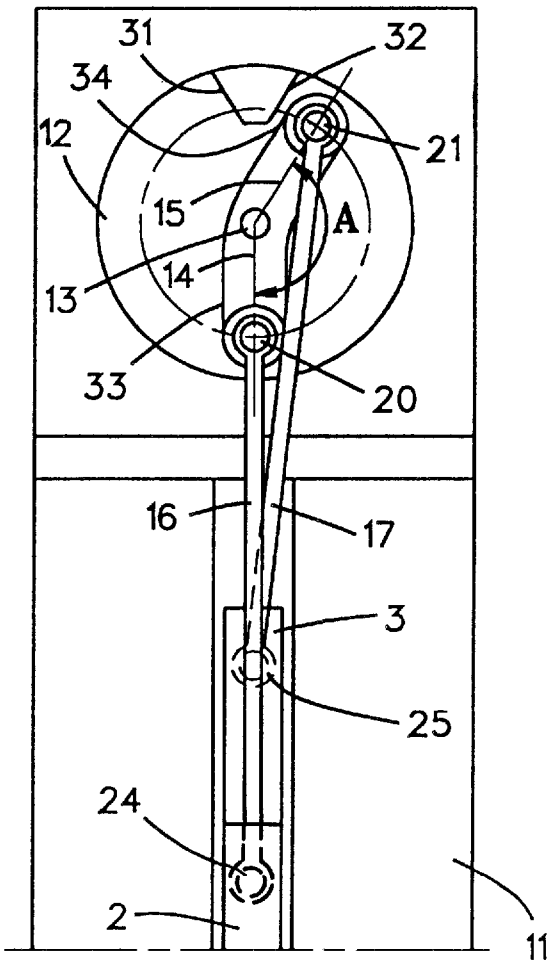

In the view of FIG. 2, the thread guide element 2 is in its upper end position and the thread guide element 3 is in its lower end position. The crank 15 belonging to the thread guide element 3 and the associated crank rod 17 substantially run colinearly with the thread guide element 3. In the view of FIG. 3, the selvage threads 8, 9 and the thread guides 4, 5 of the thread guide elements 2, 3 are equally high at a height denoted as the crossing height. Such a crossing takes place during an instant denoted as the crossing time. In the view of FIG. 4, the thread guide element 2 is in its lower end position whereas the thread guide element 3 is at its upper end position. The crank 14 belonging to the thread guide element 2 and the coupling rod 16 essentially run colinearly with the thread guide element 2.

To weave inserted fillings, the thread guide elements 2, 3 are displaced to and fro by the drive motor 12 between the end positions of FIGS. 2 and 4. If for each path loop the thread guide elements 2, 3 are moved to and fro between the positions of FIGS. 2 and 4, a one/one formation results. If the to and fro motion of the thread guide elements 2, 3 takes place every two weaving cycles, a two/two weave results. Arbitrary weaves can be formed by appropriately displacing the thread guide elements 2, 3, for instance a one/two or a one/three weave. For such purposes the drive motor 12 is controlled in such manner that the motor shaft 13 is rotated to and fro between the end positions shown in FIGS. 2 and 4 the thread guide elements 2, 3 are displaced along the direction X corresponding to the longitudinal guides 6, 7 between the described end positions. The cranks 14, 15 are mutually displaced by an angle A such that the thread guide elements 2, 3 shall carry out mutually opposite motions. A shed 10 is formed by the selvage threads 8, 9 for each displacement of the thread guide elements 2, 3 between the positions of FIGS. 2 and 4 to receive one or more fillings, while at the same time a binding is implemented for the filling(s) previously inserted. The angular separation A is shown especially clearly in FIG. 3, the angular separation A denoting the angle which is subtended on the side facing the thread guide elements 2, 3.

The local control unit 18 mounted on the frame 11 cooperates with the loom control unit 19. The control unit 19 transmits signals to the local control unit 18. said signals controlling the position to be assumed by the motor shaft 13 of the drive motor 12. In the process, the angular speed of the motor shaft also is predetermined; that is, how fast the motor shaft shall move from one end position to the other.

The signals transmitted from the loom control unit 19 to the local control unit 18 are determined by loom parameters. Illustratively a signal is transmitted which is proportional to the position and to the average speed of the loom main shaft. The control unit 19 picks up this signal in the form of signals from a detector 28 cooperating with a shaft 30 rotating synchronously with the loom main shaft, in particular by means of an encoder disk 29. The local control unit 18 receives the signals from the control unit 19 and thereupon controls the position and the speed of the motor shaft 13 as a function of said signal. As a result, the motor shaft 13 assumes a position depending on the position of the loom main shaft.

The controlled positioning of the motor shaft 13 allows setting the crossing point of the selvage threads 8, 9 at a desired time in the weaving cycle. Moreover the control unit 19 may also be designed in such manner that it shall change the crossing point as a function of the loom's weaving parameters without the need to stop the loom. Illustratively the crossing point may be adapted to each weaving cycle, for instance depending on the sort of filling insertion, the inserted filling duct and other weaving parameters.

The angular separation A between the cranks 14, 15 being larger than 120°, the path of the thread guide elements 2, 3 between the end positions of FIGS. 2 and 4 is substantially larger than the axial length of the cranks 14, 15. As a result the torque which must be delivered by the drive motor 12 to rotate the cranks 14, 15, may be kept low. The selvage forming device also offers the advantage that for a selvage thread 8, 9 opened into a shed 10, when the selvage threads 8, 9 are tensioned and exert corresponding forces on the thread guide elements 2, 3, the cranks 14, 15 and the coupling rods 16, 17 run essentially colinearly. A relatively small rotation of the motor shaft therefore entails only small displacements of the thread guide elements 2, 3, whereby the torque required from the drive motor 12 to further open the selvage threads 8, 9 into a shed or to preserve the shed 10 remains limited. As a result a relatively weak drive motor 12 may also be used, being commensurately small and easily integrated and economical. A comparatively weak drive motor 12 also draws less power and as a result a simpler local control unit 18 may be used. This feature is especially advantageous when the drive motor 12 is a stepper motor.

The crossing height, that is the height at which the thread guides 4, 5 of the thread guide elements 2, 3 and hence also the selvage threads 8, 9 are at the same height (FIG. 3), is determined by the angular separation A of the cranks 14, 15. During weaving and when forming the selvages or waste strips, the crossing height advantageously shall be below half the path of the selvage to threads 8, 9 for forming the shed 10. This feature assures good weaving. The selection of the angular separation A to be less than 180° offers the advantage that the crossing height will be located closer to the lower end position and farther removed from the upper end position of the thread guides 4, 5 of the thread guide elements 2, 3, the smaller the angular separation A. In the illustrative embodiment shown, wherein the angular separation A is approximately 150°, the crossing height is somewhat below half the path of the thread guide elements 2, 3.

The particular angular separation A to be selected so that the crossing height shall be below the middle of the paths of the selvage threads 8, 9 depends on the ratio of the length of the cranks 14, 15 to the length of the coupling rods 16, 17. When this ratio is very small, the angular separation A may approach 180°. If the length of the coupling rods 16, 17 is about 4-fold to 5-fold the length of the cranks 14, 15 as in the shown embodiment, then an angular separation A between 170° and 175° may suffice to place the crossing height below the middle of the paths of the selvage threads 8, 9.

When using a controllable stepper motor as the drive motor 12, then the motor will be rotated stepwise by the application of positive or negative voltage pulses to the terminals of this stepper motor. Appropriately a reference position shall be set up for the stepper motor in order that the position of the drive shaft 13 (motor shaft) shall be known as a function of the number of steps by which the motor shaft was rotated subsequently on account of the sequential voltage pulses.

As shown in FIGS. 2 through 4, the selvage forming device 1 comprises at least one stop 31, 32 for stop elements 33, 34 moving together with the drive shaft 13. In the embodiment shown, a reference position will be formed in that a mating element 33 of the crank 14 touches the stop 31. The two stops 31, 32 are mounted in such predetermined positions that the maximum path of the cranks 14, 15 and thereby also that of the drive shaft 13 shall be limited. This feature precludes the cranks 14, 15 from colliding with the coupling rods 16, 17.

If illustratively the design is such that the full path between the positions wherein the crank 14 rests against the stop 31 and the crank 15 against the stop 32 shall correspond to the 90 steps of the stepper motor, then illustratively the stepper motor will be loaded with voltage pulses corresponding to 96 steps toward the stop 31 for the purpose of moving toward the reference position. Independently of the initial position, the crank 14 together with this stop element 33 is thus moved against the stop 31. Thereupon the drive shaft is moved by one step of the stepper motor in the opposite direction, whereby the stop element 33 is clear off the stop 31. This is then the reference position from which the stepper motor is moved for instance by 88 steps in order that the two end positions corresponding to FIGS. 2 and 4 are assumed to form the particular desired weave using the thread guide elements 2, 3. in order to move the stepper motor into a desired position, suitable control and latching currents are applied to the stepper motor. The terminals of the stepper motor are so associated with the stop 31 that the stepper motor will move by one step away from the stop 31 into the reference position when its terminals are loaded with corresponding voltage pulses.

Because the angle of rotation undergone by the drive motor 12 is limited, the path of the thread guide elements 2, 3 may be predetermined. If the path is selected to be between the positions shown in FIGS. 2 and 4, optimal advantage is taken of a limited torque to form an open shed 10 and to hold the selvage threads 8, 9 at an open shed.

Figure 5:
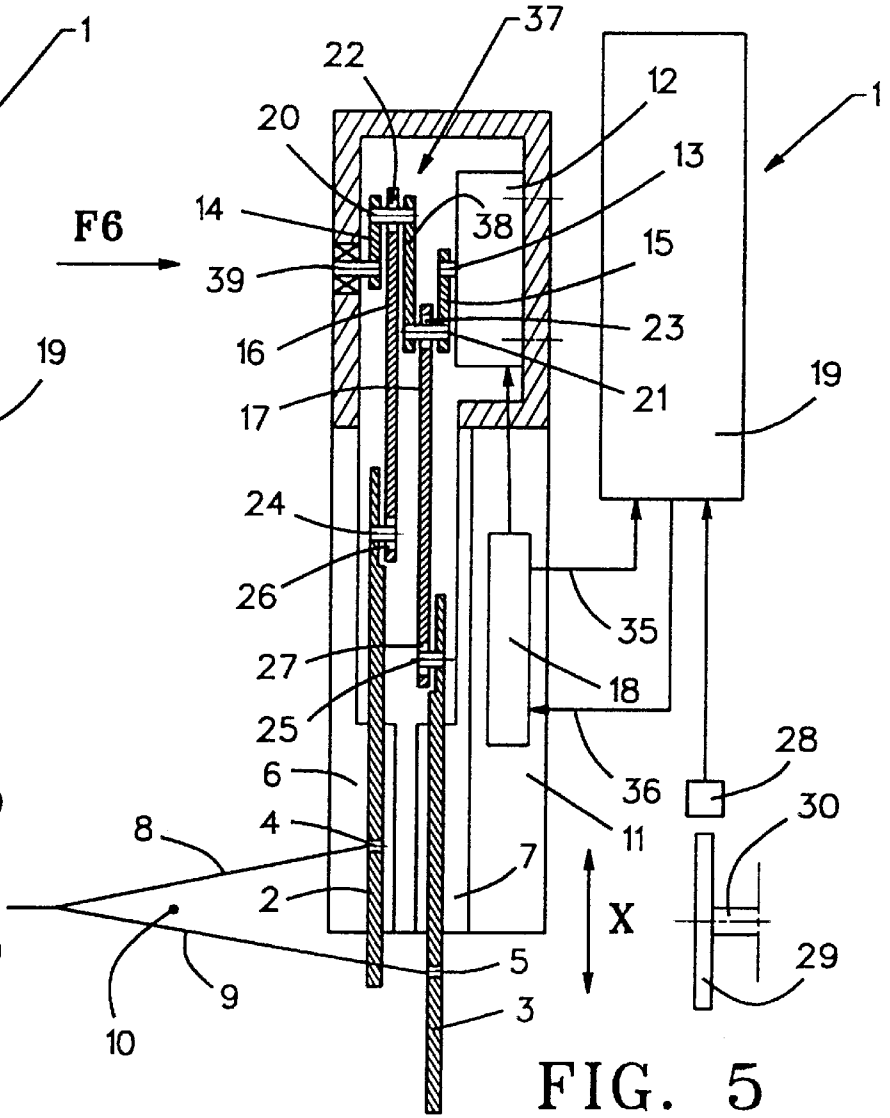
FIG. 5 is a partly sectional, schematic view of another embodiment of a selvage forming device of the invention.
Figure 6:
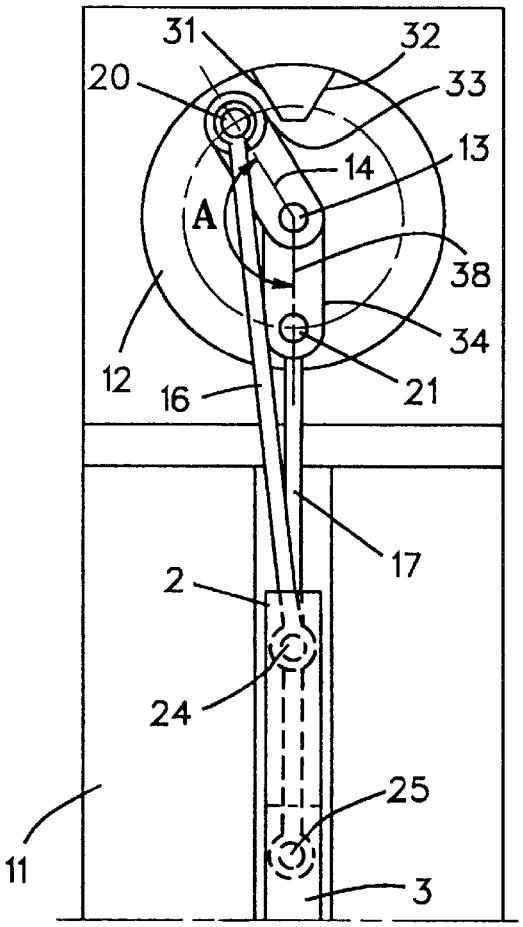
FIG. 6 is a view in the direction of the arrow F5 of the selvage forming device of FIG. 5.

In the embodiment of FIGS. 5 and 6, the cranks 14, 15 are part of a crankshaft 37 driven by the drive motor 12. The crankshaft is composed of a crank 15 irrotationally affixed to the driver shaft 13, of an interim link 38 and a crank 14 rotatably supported by a shaft 39 in the frame 11, said shaft 39 being mounted coaxially with the drive shaft 13. The cranks 14, 15 are resp. linked by crankpins 20, 21 to the interim link 38, the coupling rods 16, 17 resting by bearing 22, 23 on said pins 20, 21. It is possible in this design that the drive motor 12 shall be rotating only in one direction. Preferably however the drive motor shall be rotatable to and fro in this design too in order to form a shed 10 from the selvage threads 8, 9. The path followed by the cranks 14, 5 in this embodiment is also limited by stops 31, 32, one of which serves as a reference stop. Moreover the angular separation A between the cranks 14, 15 on the side facing the thread guide elements 2, 3 shall be between 120° and 180°, preferably approximately 150°.

The controlled drive motor 12 also may be a servomotor, in particular a single phase motor with variable reluctance. Such motors are known for instance from the U.S. Pat. No. 4, 043,618 or from the British patent 1,507,790 and allow controlling the position and speed of the motor shaft in simple, accurate and economical manner as a function of signals derived from position, speed of another shaft, for instance shaft 30, running synchronously with the main shaft of a loom.

The selvage forming device 1 of the invention allows changing the weave pattern during weaving without resort to mechanical changes. Illustratively a one/one weave can be changed during weaving into a two/two weave or a one/two weave or a one/three weave solely by controlling the drive motor 12 by means of the control unit 18, 19 so that the thread guide elements 2, 3 shall carry out the desired motion. To implement a one/one weave, the thread guide elements 2, 3 are displaced between their end positions during each weaving cycle. With respect to a two/two weave, this motion between the end positions takes place after two weaving cycles. Other weaves can be implemented in similar manner.

Because the thread guide elements 2, 3 are displaced by the controlled drive motor 12, the crossing time of these thread guide elements 2, 3 is predeterminable in simple manner as a function of the loom's main shaft, in particular the speed of the drive motor 12 being controlled during one weaving cycle as a function of the loom speed.

The selvage forming device 1 is mounted on a frame 11 and as a result it is easily mounted to a loom and removed from it again. Moreover the selvage forming device is affixed to the loom framework to take into account the loom width, and hence it is also applicable to looms weaving fabrics of different widths. The selvage forming device of the invention is height-adjustable, and therefore the shed formed by the selvage threads 8, 9 can be present in the extension of the shed formed by the warps. The selvage forming device of the invention also may be mounted at the end of a loom shed or also between consecutive sheds, for instance when two or more fabrics are being woven next to each other on one loom. The selvage forming device 1 is connected only by electric cables 35, 36 to the control unit 19 of the loom, and accordingly its position or mounting is easily changed.

Figure 7:
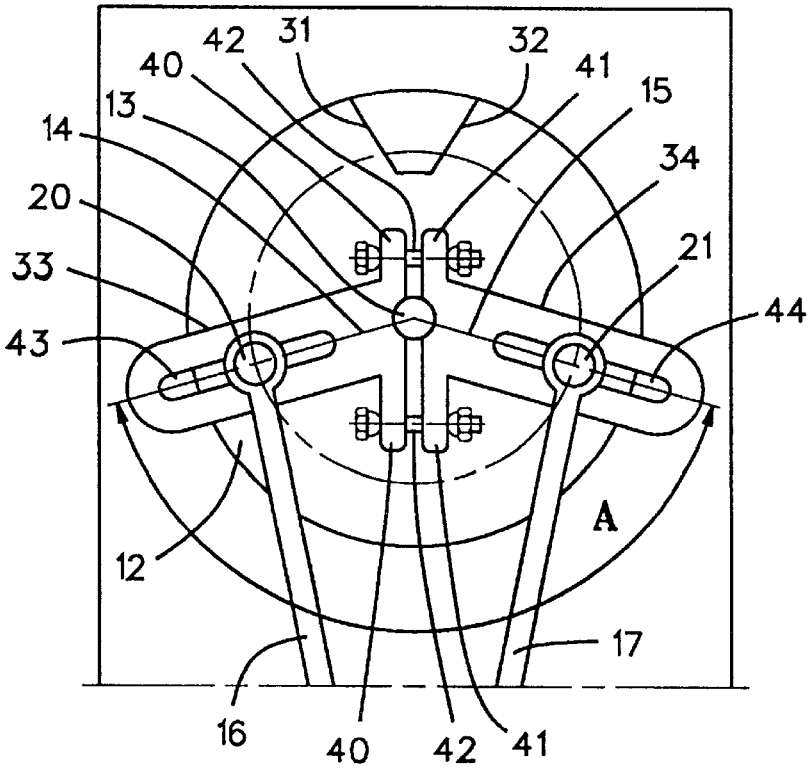
FIG. 7 is a view similar to FIG. 2 on a larger scale of a selvage forming device with its angularly adjustable cranks fitted with articulation points that are radially adjustable relative to the drive shaft.

FIG. 7 shows an embodiment with adjustable angular separation A between the cranks 14, 15. At their ends facing the drive shaft 13, the cranks 14, 15 are fitted with flanges 40, 41 each comprising a partly cylindrical recess for the drive shaft 13. The flanges 40, 41 are tightened to each other by screw elements 42 and are clamped onto the drive shaft 13. The screw elements 42 are composed of screws and nuts each with a rounded rest surface whereby they rest on the flanges 40, 41 in order to thereby absorb angular deviations. The embodiment of FIG. 7 moreover offers the feature of the articulation points of the coupling rods 16, 17 being adjustable in the radial direction at the cranks 14, 15, as a result of which the crank radius is variable relative to the drive shaft 13 and thereby also the path of the thread guide elements 2, 3 (omitted from FIG. 7). The cranks 14, 15 are fitted with elongated slots 43, 44 running essentially radially to the drive shaft 13. The pins 20, 21 are fitted with an (omitted) collar and a thread that may receive a nut, whereby the pins can be clamped tight in a selected radial position on the cranks 14, 15.

In an embodiment variant, the selvage forming device 1 comprises more than two thread guide elements 2, 3 each driven by a drive motor 12. Illustratively four thread guide elements may be used, always forming a set of two thread guide elements carrying out opposite displacement. In such a case each set is then driven by its own drive motor 12 and its own drive shaft 13. This feature allows very special weaves with several selvage threads.

In another embodiment variant, the local control unit 18 of the selvage forming device 1 is eliminated and the function of the local control unit 18 is assumed by the loom control unit 19.

The selvage forming device of the invention may be used in any sort of loom, for instance an airjet loom, a gripper loom, a projectile loom or other loom.

In still another embodiment variant, a disk replaces the cranks and is fitted with a plurality of holes receiving the pins 20, 21 linking the coupling rods 16, 17. This feature also allows adjusting in simple manner the angular separation A between the articulation points of the coupling rods and the radial distance between the articulation points and the drive shaft 13.

The embodiment evincing the coupling rods and cranks offers the advantage that by means of the coupling rods 16, 17 paths larger than the crank length may be derived from the crank rotation for the longitudinal displacement of the thread guide elements 2, 3.

In another embodiment variant, an absolute-measurement displacement sensor is associated to the drive shaft 13 and is connected to the local control unit 18 or to the loom control unit 19. As a result, the accurate position of the drive shaft 13 and hence also of the thread guide elements 2, 3 can be ascertained and analyzed at all times.

We claim:

1. A power-loom selvage forming device comprising:

at least two selvage thread guides mounted for longitudinal reciprocal motion and selvage thread guide supports associated with relatively fixed loom structure arranged for guiding the motion of the selvage thread guides;

a drive motor; and a drive shaft driven by the motor and extending perpendicular to the direction of motion of the selvage thread guides;

transmission elements connecting each selvage thread guide to the drive shaft;

said transmission elements arranged to convert rotary drive shaft motion to rectilinear selvage thread guide motion;

said transmission elements each including at least a first portion secured to the drive shaft and at least a second portion secured to one of the selvage thread guides, each transmission element including an articulation point connecting the first and second portions, and each articulation point being located eccentrically of the drive shaft;

said articulation points being spaced by an angle of separation and located at opposite sides of the drive shaft; and a control system for actuating the drive motor to cause predetermined angular rotations of said drive shaft at predetermined times to thereby cause timed shed forming motions of the selvage thread guides.

2. The selvage forming device according to claim 1, wherein said angular separation is greater than 120°.

3. The selvage forming device according to claim 2, wherein said angular separation is less than 180°.

4. The selvage forming device according to claim 1, wherein said angular separation is less than 180°.

5. The selvage thread forming device according to claim 1, including a separation angle adjustment mechanism for adjusting the angle of separation of the articulation points.

6. The selvage forming device according to claim 1, including a radial separation mechanism for adjusting radial distances between the articulation points and the drive shaft.

7. The selvage forming device according to claim 6, including a separation angle adjustment mechanism for adjusting the angle of separation of the articulation points.

8. The selvage forming device according to claim 1, wherein said first portions are crank elements directly connected to said drive shaft and said second portions are pivotally linked at said articulation points to said first portions.

9. The selvage forming device according to claim 8, wherein both said crank elements constitute a single integral element.

10. The selvage forming device according to claim 8, wherein said crank elements are connected to said drive shaft and an angular separation adjustment device that is arranged such that the angular position of each crank element relative to said drive shaft is independently adjustable.

11. The selvage forming device according to claim 1, including a position signal generating device that includes a device for determining the location of at least the angular position of said drive shaft and generating drive shaft position signals corresponding to the drive shaft angular positions, and a device for communicating the drive shaft position signals to said control system.

12. The selvage forming device according to claim 11, wherein said drive motor is an electric stepper motor.

13. The selvage forming device according to claim 12, wherein said drive shaft is arranged such that rotation of said drive shaft through said predetermined angular rotations drives said transmission elements and thread guides along a normal displacement path, wherein further rotation of said drive shaft drives at least a portion of said transmission elements or at least one of the selvage thread guides beyond said normal displacement path, and wherein said device for detecting the angular position of at least said drive shaft includes a reference position stop located outside said normal displacement path, said reference position stop being adapted to be engaged by said portion of said transmission elements or said at least one of said selvage thread guides driven during extended motion of such transmission elements or thread guides beyond said normal displacement path.

14. The selvage forming device according to claim 1, wherein said control system includes a drive motor control separate from and connected to a loom control unit.

15. The selvage forming device according to claim 1, wherein said drive motor, thread guides and transmission elements constitute a single integrated modular assembly.

16. The selvage forming device according to claim 1, wherein said drive shaft is located above said selvage thread guides when the selvage forming device is adapted to be installed in a loom.

* * * * *